US008258718B2

(12) United States Patent
Arai

(10) Patent No.: US 8,258,718 B2
(45) Date of Patent: Sep. 4, 2012

(54) LIGHTING DEVICE AND DISPLAY DEVICE

(75) Inventor: Masahiro Arai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 12/864,008

(22) PCT Filed: Oct. 3, 2008

(86) PCT No.: PCT/JP2008/068065

§ 371 (c)(1),
(2), (4) Date: Jul. 22, 2010

(87) PCT Pub. No.: WO2009/098800

PCT Pub. Date: Aug. 13, 2009

(65) Prior Publication Data

US 2010/0289420 A1 Nov. 18, 2010

(30) Foreign Application Priority Data

Feb. 8, 2008 (JP) ..... 2008-029196

(51) Int. Cl.
*H05B 37/02* (2006.01)

(52) U.S. Cl. ..... 315/291; 315/307; 315/226; 315/276

(58) Field of Classification Search ..... 315/209 R, 315/219, 226, 246, 276, 282, 291, 307
See application file for complete search history.

(56) References Cited

U.S. PATENT DOCUMENTS

| | | | | |
|---|---|---|---|---|
| 6,661,181 | B2 | 12/2003 | Shin | |
| 6,788,006 | B2 | 9/2004 | Yamamoto | |
| 7,211,966 | B2 * | 5/2007 | Green et al. | 315/224 |
| 2003/0222593 | A1 * | 12/2003 | Yamamoto | 315/219 |
| 2005/0110732 | A1 * | 5/2005 | Kim | 345/87 |
| 2008/0258640 | A1 * | 10/2008 | Masuda | 315/224 |
| 2009/0243994 | A1 * | 10/2009 | Hatano et al. | 345/102 |
| 2010/0149428 | A1 | 6/2010 | Kishimoto | |

FOREIGN PATENT DOCUMENTS

| | | | |
|---|---|---|---|
| JP | 2000-292767 | A | 10/2000 |
| JP | 2002-231034 | A | 8/2002 |
| JP | 2007-200901 | A | 8/2007 |
| WO | 2007/091345 | A1 | 8/2007 |

OTHER PUBLICATIONS

Official Communication issued in International Patent Application No. PCT/JP2008/068065, mailed on Jan. 13, 2009.

* cited by examiner

*Primary Examiner* — Don Le
(74) *Attorney, Agent, or Firm* — Keating & Bennett, LLP

(57) ABSTRACT

A lighting device (8) including a cold-cathode fluorescent tube (light source) (9) includes an inverter circuit (16) connected to the cold-cathode fluorescent tube (9) and configured so as to driving the cold-cathode fluorescent tube (9), using PWM dimming. The inverter circuit (16) drives the cold-cathode fluorescent tube (9) while a dimming signal in the PWM dimming and a driving signal for driving the cold-cathode fluorescent tube (9) are synchronized.

6 Claims, 9 Drawing Sheets

LIGHTING DEVICE AND DISPLAY DEVICE

TECHNICAL FIELD

The present invention relates to a lighting device, in particular, a lighting device using a cold-cathode fluorescent tube or the like as a light source, and a display device using the lighting device.

BACKGROUND ART

In recent years, for example, liquid crystal display devices have been used widely in liquid crystal TVs, monitors, and mobile telephones, as flat panel displays having features such as thinness and light weight, compared with conventional Braun tubes. Such a liquid crystal display device includes a lighting device (backlight) emitting light and a liquid crystal panel displaying a desired image by playing a role of a shutter with respect to light from a light source provided in the lighting device.

Further, the above-mentioned lighting devices are classified roughly into a direct-type and an edge-light type depending upon the arrangement of light sources with respect to the liquid crystal panel. A liquid crystal display device having a liquid crystal panel of 20 inches or more generally uses the direct type lighting device that can achieve the increase in brightness and enlargement more easily than the edge-light type lighting device. More specifically, in the direct type lighting device, a plurality of linear light sources are placed on a rear side (non-display surface) of the liquid crystal panel, and the linear light sources can be placed right on a reverse side of the liquid crystal panel, which enables a number of linear light sources to be used. Thus, the direct type lighting device can obtain high brightness easily, and is suitable for the increase in brightness and enlargement. Furthermore, the direct type lighting device has a hollow structure, and hence, is light-weight even when enlarged. This also allows the direct type lighting device to be suitable for the increase in brightness and enlargement.

Further, in the conventional direct type lighting device as described above, for example, as described in JP 2002-231034 A, it is proposed that a plurality of cold-cathode fluorescent tubes are provided as light sources, and inverter circuits are connected to the respective cold-cathode fluorescent tubes to drive the respective cold-cathode fluorescent tubes with high-frequency lighting by the inverter circuits.

Further, for example, as described in JP 2000-292767 A, it is proposed that the conventional lighting device adjusts the amount of light incident upon a liquid crystal panel from a light-emitting plane by lighting cold-cathode fluorescent tubes using pulse width modulation (PWM), thereby controlling the lightness (brightness) on a display surface of the liquid crystal display device. More specifically, in the conventional lighting device, it is shown that a liquid crystal display device excellent in display performance (lightness) is configured using PWM dimming whose dimming range on a light-emitting plane, i.e., an adjustable brightness range is larger than that of the conventional current dimming.

DISCLOSURE OF INVENTION

Problem to be Solved by the Invention

However, in the above-mentioned conventional lighting device, a driving signal for driving cold-cathode fluorescent tubes (light sources) and a dimming signal in the PWM dimming are not synchronized, and a lighting operation of the cold-cathode fluorescent tube is recognized visually as flickering, which may degrade light-emission quality.

Specifically, in the conventional lighting device, the dimming signal in the PWM dimming is set at a frequency of about 100 to 600 Hz, and during an ON-time determined by an instruction signal from outside, the driving signal of the cold-cathode fluorescent tube is output to the inverter circuit from a controller of the lighting device at an operation frequency of about 30 to 60 KHz, whereby the cold-cathode fluorescent tube is lit. In such a lighting operation of the cold-cathode fluorescent tube, the driving signal and the dimming signal are determined separately in the conventional lighting device.

Therefore, in the conventional lighting device, depending upon the frequency and the ON-time in the PWM dimming, the operation frequency of the driving signal, and the like, the number of driving signals included in the ON-time may vary for each period in the PWM dimming, and the lighting operation of the cold-cathode fluorescent tube may be recognized visually as flickering. As a result, in the conventional lighting device, there is a problem that light-emission quality is degraded.

In view of the above-mentioned problems, it is an object of the present invention to provide a lighting device excellent in light-emission quality capable of preventing the occurrence of flickering, and a display device using the lighting device.

Means for Solving Problem

In order to achieve the above-mentioned object, a lighting device according to the present invention has a light source. The lighting device includes an inverter circuit connected to the light source and configured so as to drive the light source, using PWM dimming, wherein the inverter circuit drives the light source while a dimming signal in the PWM dimming and a driving signal for driving the light source are synchronized.

In the lighting device configured as described above, the inverter circuit drives the light source while the dimming signal in the PWM dimming and the driving signal for driving the light source are synchronized. Thus, unlike the above-mentioned conventional example, the lighting operation of the light source can be prevented from being recognized visually as flickering. Consequently, a lighting device excellent in light-emission quality capable of preventing the occurrence of flickering can be configured.

Further, it is preferred that the above-mentioned lighting device includes a controller that generates the driving signal, and determines a duty ratio in the PWM dimming, using an instruction signal input from outside and generates the dimming signal based on the determined duty ratio, thereby controlling the inverter circuit.

In this case, the controller can cause the light source to be driven while the inverter circuit synchronizes the dimming signal and the driving signal, thereby preventing the occurrence of flickering in the light source exactly.

Further, in the lighting device, the inverter circuit includes first and second switching members that receive first and second driving signals different in phase by 180° as the driving signal from the controller, and performs ON/OFF control of supply of power to the light source, and the controller may output the first and second driving signals respectively to the first and second switching members while one driving signal of the first and second driving signals and the dimming signal are synchronized.

In this case, the light source is lit while one of the driving signals and the dimming signal are synchronized, and hence, the occurrence of flickering in the light source can be prevented more exactly.

Further, in the above-mentioned lighting device, it is preferred that the controller includes a synchronizing clock signal generation unit that generates a synchronizing clock signal, and the controller synchronizes the dimming signal with the synchronizing clock signal from the synchronizing clock signal generation unit, and generates the driving signal, using the synchronized dimming signal.

In this case, the driving signal and the dimming signal can be synchronized with high precision without causing a decrease in dimming precision in the PWM dimming, and a lighting device excellent in light-emission quality can be configured more exactly.

Further, in the above-mentioned lighting device, the dimming signal and the driving signal may be set so that rising phases are matched.

In this case, the occurrence of flickering in the light source can be prevented more easily.

Further, in the above-mentioned lighting device, the dimming signal and the driving signal may be set so that falling phases are matched.

In this case, the occurrence of flickering in the light source can be prevented more easily.

Further, in the lighting device, a cold-cathode fluorescent tube may be used as the light source.

In this case, a lighting device that is compact in size and excellent in light-emission efficiency can be configured easily.

Further, a display device of the present invention is characterized by using any one of the lighting devices.

In the display device configured as described above, a lighting device excellent in light-emission quality capable of preventing the occurrence of flickering is used, and hence, a display device having excellent display quality can be configured easily.

Effects of the Invention

According to the present invention, a lighting device excellent in light-emission quality capable of preventing the occurrence of flickering, and a display device using the lighting device can be provided.

DESCRIPTION OF THE INVENTION

Hereinafter, preferred embodiments of a lighting device of the present invention, and a display device using the lighting device will be described with reference to the drawings. In the following description, the case where the present invention is applied to a transmission-type liquid crystal display device will be described. Further, the dimensions of constituent members in each figure do not faithfully reflect the actual dimensions of the constituent members, the dimension ratio of the respective constituent members, and the like.

[Embodiment 1]

Figure 1:
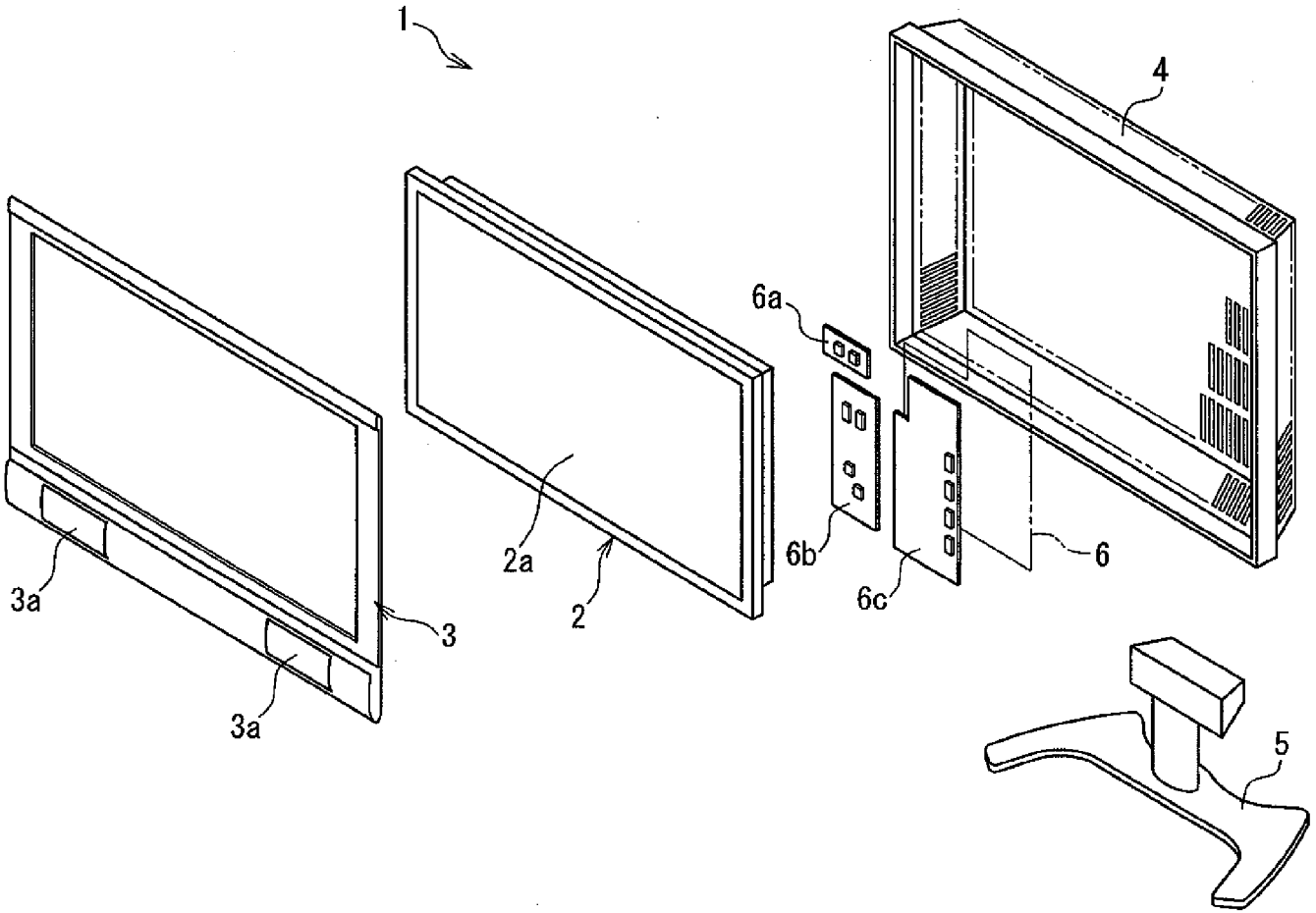
FIG. 1 is an exploded perspective view illustrating a TV receiver and a liquid crystal display device according to one embodiment of the present invention.

FIG. 1 is an exploded perspective view illustrating a TV receiver and a liquid crystal display device according to one embodiment of the present invention. In FIG. 1, a TV receiver 1 of the present embodiment includes a liquid crystal display device 2 as a display device, and is configured so as to receive TV broadcasting through an antenna or a cable (not shown). The liquid crystal display device 2 is allowed to stand by a stand 5 while being housed in a front cabinet 3 and a back cabinet 4. Further, in the TV receiver 1, a display surface 2*a* of the liquid crystal display device 2 is configured so as to be recognized visually via the front cabinet 3. The display surface 2*a* is set in parallel to a gravity acting direction (vertical direction) by the stand 5.

Further, in the TV receiver 1, a TV tuner circuit board 6*a*, a control circuit board 6*b* controlling each portion of the TV receiver such as a lighting device described later, and a power circuit board 6*c*, which are to be attached to a support plate 6, are placed between the liquid crystal display device 2 and the back cabinet 4. Then, in the TV receiver 1, an image based on a video signal of TV broadcasting received by a TV tuner on the TV tuner circuit board 6*a* is displayed on the display surface 2*a*, and a sound is reproduced and output from speakers 3*a* provided on the front cabinet 3. The back cabinet 4 is provided with a number of vents, so that the heat generated in the lighting device, power source, and the like can be radiated appropriately.

Next, the liquid crystal display device 2 will be described specifically with reference to FIG. 2.

Figure 2:
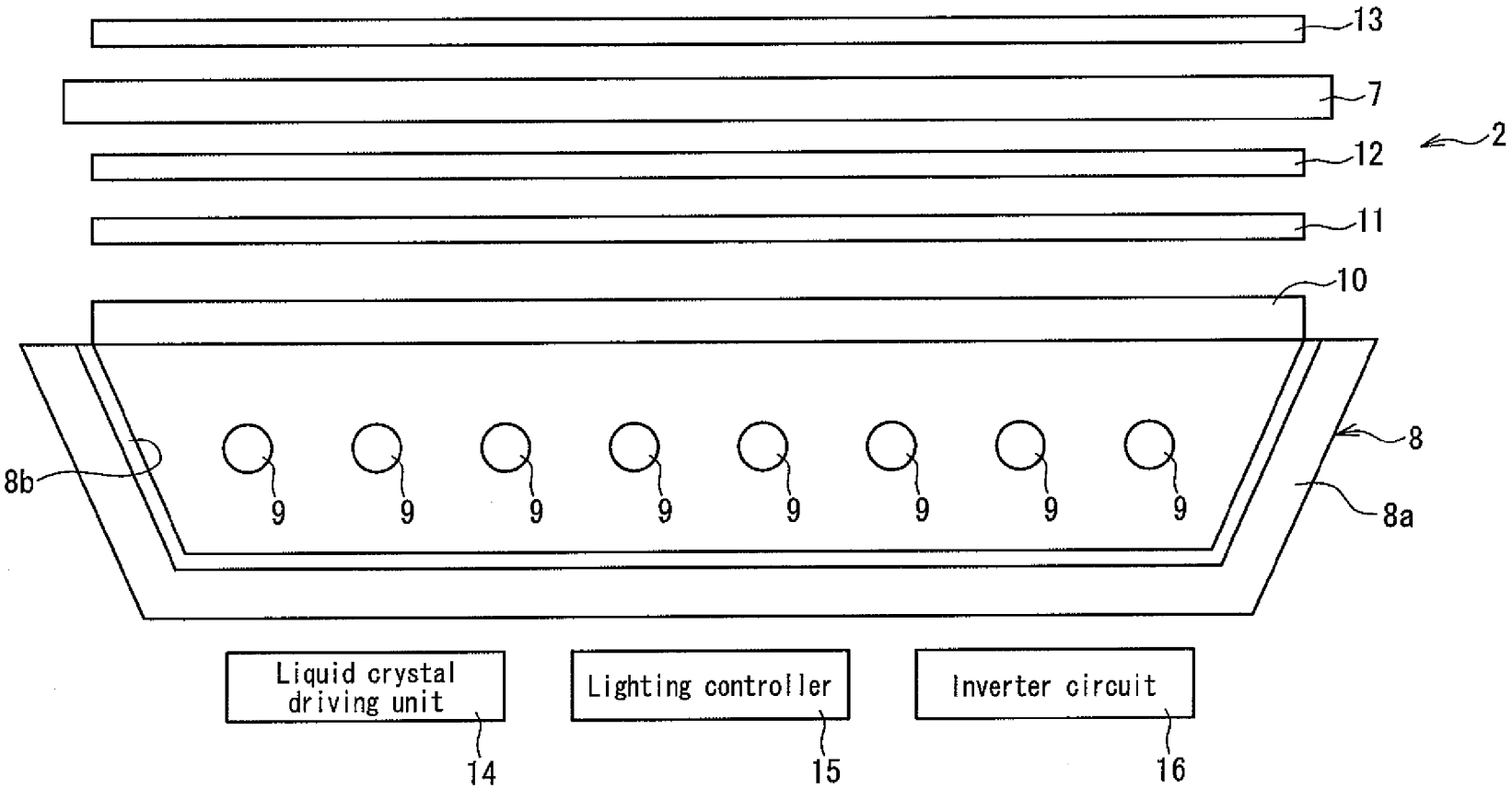
FIG. 2 is a view illustrating a configuration of main portions of the liquid crystal display device.

FIG. 2 is a view illustrating a configuration of main portions of the liquid crystal display device. In FIG. 2, the liquid crystal display device 2 includes a liquid crystal panel 7 as a display portion that displays information such as characters and images and a lighting device 8 of the present invention, which is placed on a non-display surface side (lower side in the figure) of the liquid crystal panel 7 and generates illumination light illuminating the liquid crystal panel 7, and the liquid crystal panel 7 and the lighting device 8 are integrated as the transmission-type liquid crystal display device 2. Further, in the liquid crystal display device 2, a pair of polarizing plates 12 and 13, in which transmission axes are placed in crossed Nicols, are placed respectively on the non-display surface side and the display surface side of the liquid crystal panel 7.

The lighting device 8 includes a bottomed casing 8*a* and a plurality of cold-cathode fluorescent tubes (CCFLs) 9 housed in the casing 8*a* at an equal pitch. On an inner surface of the casing 8*a*, for example, a reflective sheet 8*b* is placed so that light from the cold-cathode fluorescent tubes 9 as light sources are reflected to the liquid crystal panel 7 side to enhance the light use efficiency of the cold-cathode fluorescent tubes 9.

Further, the straight tubes are used as the respective cold-cathode fluorescent tubes 9, and electrode portions (not shown) provided at both ends of the tubes are supported on an outer side of the casing 8*a*. Further, thinned-down tubes excellent in emission efficiency with a diameter of about 3.0 to 4.0 mm are used as the respective cold-cathode fluorescent tubes 9, which enables the lighting device 8 that is compact in size and is excellent in emission efficiency to be configured easily. Further, the respective cold-cathode fluorescent tubes 9 are held inside the casing 8*a* while each distance of the tubes with respect to a diffusion plate 10 and the reflective sheet 8*b* is kept at a predetermined distance by a light source holding tool (not shown).

Further, a plurality of the cold-cathode fluorescent tubes 9 are placed with the longitudinal direction thereof being parallel to the direction orthogonal to the gravity acting direction. Thus, in the cold-cathode fluorescent tubes 9, mercury (vapor) sealed therein is prevented from gathering at one end in the longitudinal direction due to the action of gravity, which enhances the longevity of a lamp remarkably.

Further, a liquid crystal driving unit 14 that drives the liquid crystal panel 7, a lighting controller 15 as a controller of the lighting device 8, and inverter circuits 16 that lights each of a plurality of the cold-cathode fluorescent tubes 9 at a high frequency by inverter driving, using a control signal from the lighting controller 15, are placed outside of the casing 8*a*. The liquid crystal driving unit 14, the lighting controller 15, and the inverter circuits 16 are provided on the control circuit board 6*b* (FIG. 1) and placed so as to be opposed to the outside of the casing 8*a*.

Further, in the lighting device 8, the diffusion plate 10 placed so as to cover an opening of the casing 8*a*, and an optical sheet 11 placed above the diffusion plate 10 are provided. The diffusion plate 10 is formed of, for example, a rectangular synthetic resin or glass material having a thickness of about 2 mm. Further, the diffusion plate 10 is movably held on the casing 8*a*, and due to the influence of heat such as the generation of heat of the cold-cathode fluorescent tubes 9 and an increase in temperature inside the casing 8*a*, even when the diffusion plate 10 undergoes expansion/contraction (plastic) deformation, the diffusion plate 10 can absorb the deformation by moving on the casing 8*a*.

The optical sheet 11 includes a diffusion sheet composed of, for example, a synthetic resin film having a thickness of about 0.2 mm, and the diffusion sheet diffuses the illumination light to the liquid crystal panel 7 appropriately to enhance the display quality on the display surface of the liquid crystal panel 7. Further, the optical sheet 11 is designed so as to allow known optical sheet materials such as a prism sheet and a polarization reflective sheet for enhancing the display quality on the display surface of the liquid crystal panel 7 to be laminated appropriately, if required. Then, the optical sheet 11 converts planar light output from the diffusion plate 10 into planar light having a predetermined brightness (e.g., 10000 cd/m$^2$) or more and having substantially uniform brightness and allows the planar light to be incident upon the liquid crystal panel 7 side as illumination light.

Aside from the above-mentioned description, for example, an optical member such as a diffusion sheet for adjusting a viewing angle of the liquid crystal panel 7 may be laminated appropriately above (display surface side) the liquid crystal panel 7.

Herein, the lighting device 8 of the present embodiment will be described specifically also with reference to FIGS. 3 to 5.

Figure 3:
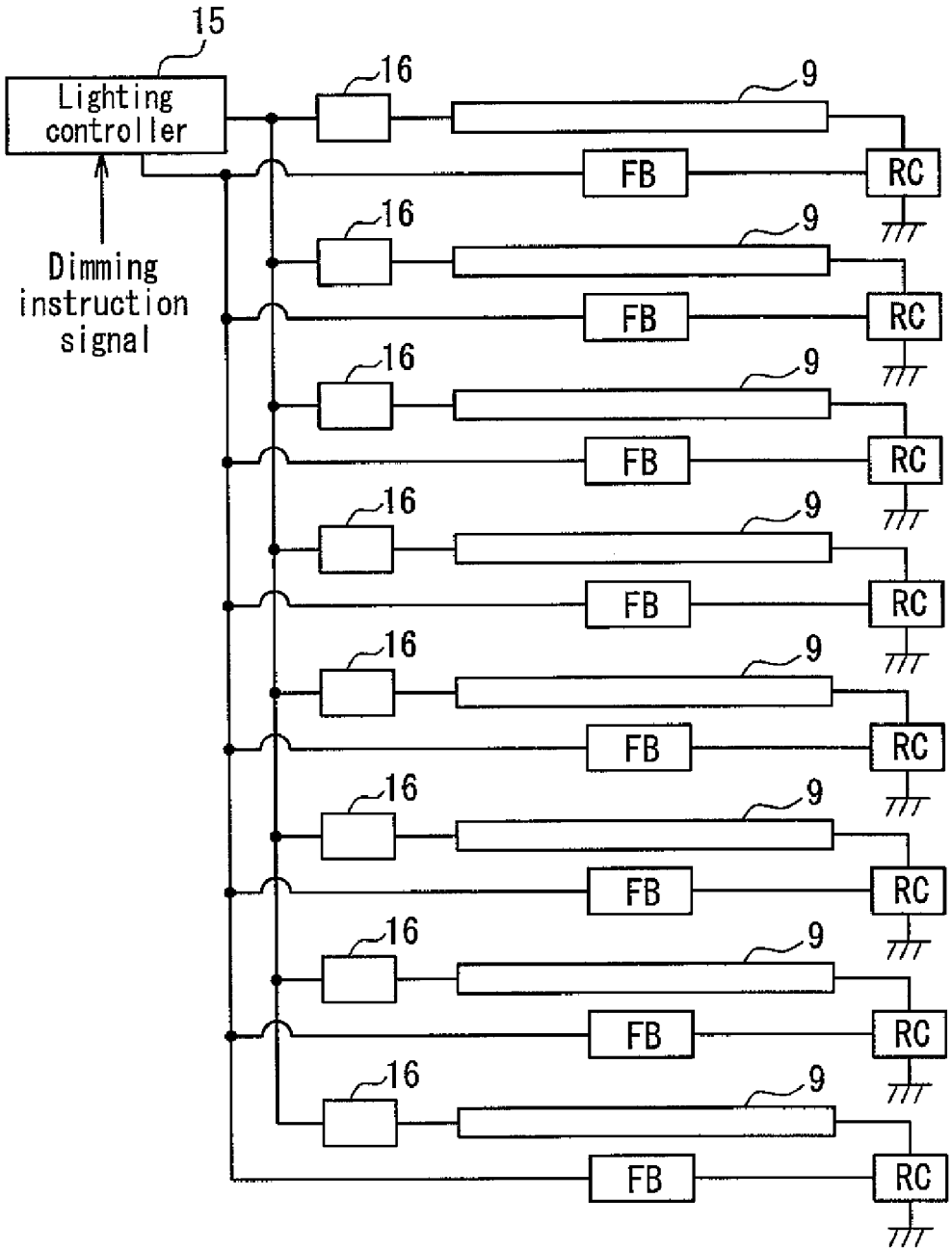
FIG. 3 is a diagram illustrating a configuration of main portions of a lighting device shown in FIG. 2.

FIG. 3 is a diagram illustrating a configuration of main portions of the lighting device shown in FIG. 2. FIG. 4 is a diagram illustrating an exemplary configuration of the inverter circuit shown in FIG. 3. FIG. 5 is a block diagram showing a specific configuration of the lighting controller shown in FIG. 2.

As shown in FIG. 3, the lighting device 8 includes the lighting controller 15 for driving each of a plurality of the cold-cathode fluorescent tubes 9 and the inverter circuits 16 as CCFL driving circuits that light the corresponding cold-cathode fluorescent tubes 9 based on a control signal (driving signal) from the lighting controller 15, provided for the respective cold-cathode fluorescent tubes 9. The inverter circuit 16 is placed at one end in a longitudinal direction of each cold-cathode fluorescent tubes 9, and supplies a current to the corresponding cold-cathode fluorescent tube 9 from one end.

Further, as the inverter circuit 16, for example, a half-bridge type is used as described later, and the inverter circuit 16 is configured so as to drive the corresponding cold-cathode fluorescent tube 9 using PWM dimming based on the driving signal.

Further, in the lighting device 8, a specific frequency of the PWM dimming is a value (e.g., 140 Hz) in a range of about 100 to 600 Hz. Further, during an ON-time of the PWM dimming, as a supply current (lamp current) to each cold-cathode fluorescent tube 9, i.e., a specific operation frequency (driving frequency of a light source) of each cold-cathode fluorescent tube 9, a value (e.g., 33.9 KHz) in a range of about 30 to 60 KHz is selected.

Further, the lighting device 8 includes lamp current detection circuits RC that detect the values of lamp currents flowing through the corresponding cold-cathode fluorescent tubes 9 provided for the respective cold-cathode fluorescent tubes 9, and in the lighting device 8, a lamp current value detected by each lamp current detection circuit RC is output to the lighting controller 15 through a feedback circuit FB placed in accordance with each cold-cathode fluorescent tube 9.

Further, the lighting controller 15 is designed to receive, for example, a dimming instruction signal that changes the brightness of a light-emitting plane of the lighting device 8 as an instruction signal from outside, and the liquid crystal display device 2 is configured so as to allow a user to change the brightness (lightness) on the display surface of the liquid crystal panel 7 appropriately. More specifically, the lighting controller 15 is configured so as to receive, for example, the dimming instruction signal from an operation input unit (not shown) such as a remote controller provided on the liquid crystal display device 2 side. Then, the lighting controller 15 determines a duty ratio in the PWM dimming, using an input dimming instruction signal, and determines a target value of a supply current to each cold-cathode fluorescent tube 9.

After that, the lighting controller 15 generates and outputs a driving signal to each inverter circuit 16 based on the determined target value, and thus, the value of a lamp current flowing through the corresponding cold-cathode fluorescent tube 9 changes. Consequently, the amount of light output from each cold-cathode fluorescent tube 9 changes in accordance with the dimming instruction signal, and the brightness on the light-emitting plane of the lighting device 8 and the brightness on the display surface of the liquid crystal panel 7 are changed appropriately in accordance with a user's operation instruction.

Further, the value of a lamp current actually supplied to each cold-cathode fluorescent tube 9 is fed back as a detected current value to the lighting controller 15 via the corresponding lamp current detection circuit RC and feedback circuit FB. Then, in the lighting controller 15, feedback control using the detected current value and the target value of a supply current determined based on the dimming instruction signal is executed, and thus, a display at a brightness desired by the user is kept.

Figure 4:
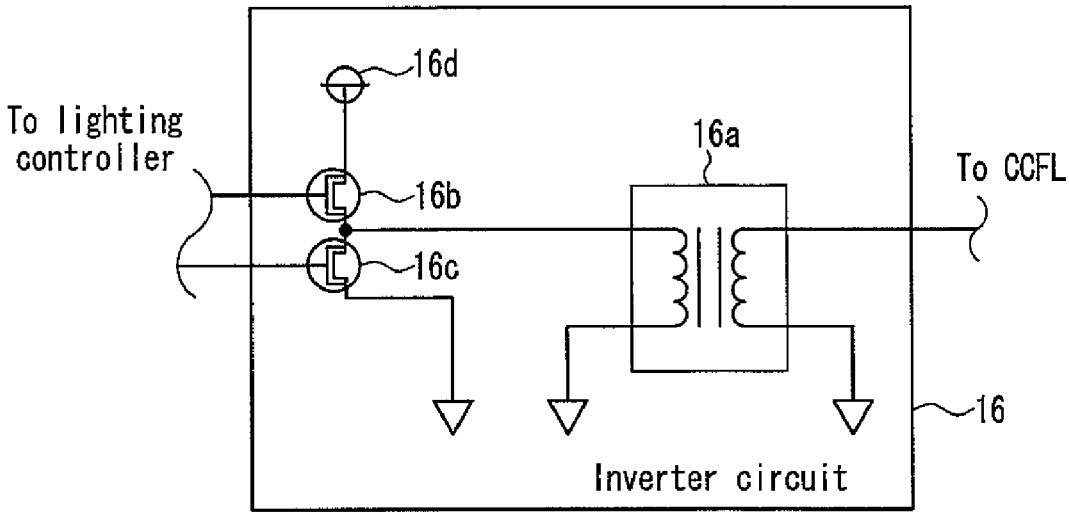
FIG. 4 is a diagram illustrating an exemplary configuration of an inverter circuit shown in FIG. 3.

As illustrated in FIG. 4, as the inverter circuit 16, a half-bridge type having a transformer 16*a*, first and second switching members 16*b*, 16*c* connected to the lighting controller 15 and provided in series on a primary winding side of the transformer 16*a*, and a driving power source 16*d* connected to the first switching 16*b* is used.

As the first and second switching members 16*b*, 16*c*, for example, field effect transistors (FETs) are used, and as described later in detail, the first and second switching members 16*b*, 16*c* respectively receive first and second driving signals, which are different in phase by 180°, as the driving signals from the lighting controller 15, thereby performing ON/OFF control of the supply of power to the cold-cathode fluorescent tube 9 connected to a secondary winding side of the transformer 16*a*.

The inverter circuit 16 lights the corresponding cold-cathode fluorescent tube 9 (FIG. 3) at a high frequency. Specifically, the secondary winding of the transformer 16*a* is connected to a high-voltage side terminal of any of the cold-cathode fluorescent tubes 9, and the first and second switching members 16*b*, 16*c* perform a switching operation based on the first and second driving signals from the lighting controller 15. Thus, the transformer 16*a* supplies power to the corresponding cold-cathode fluorescent tube 9 to light the cold-cathode fluorescent tube 9.

Figure 5:
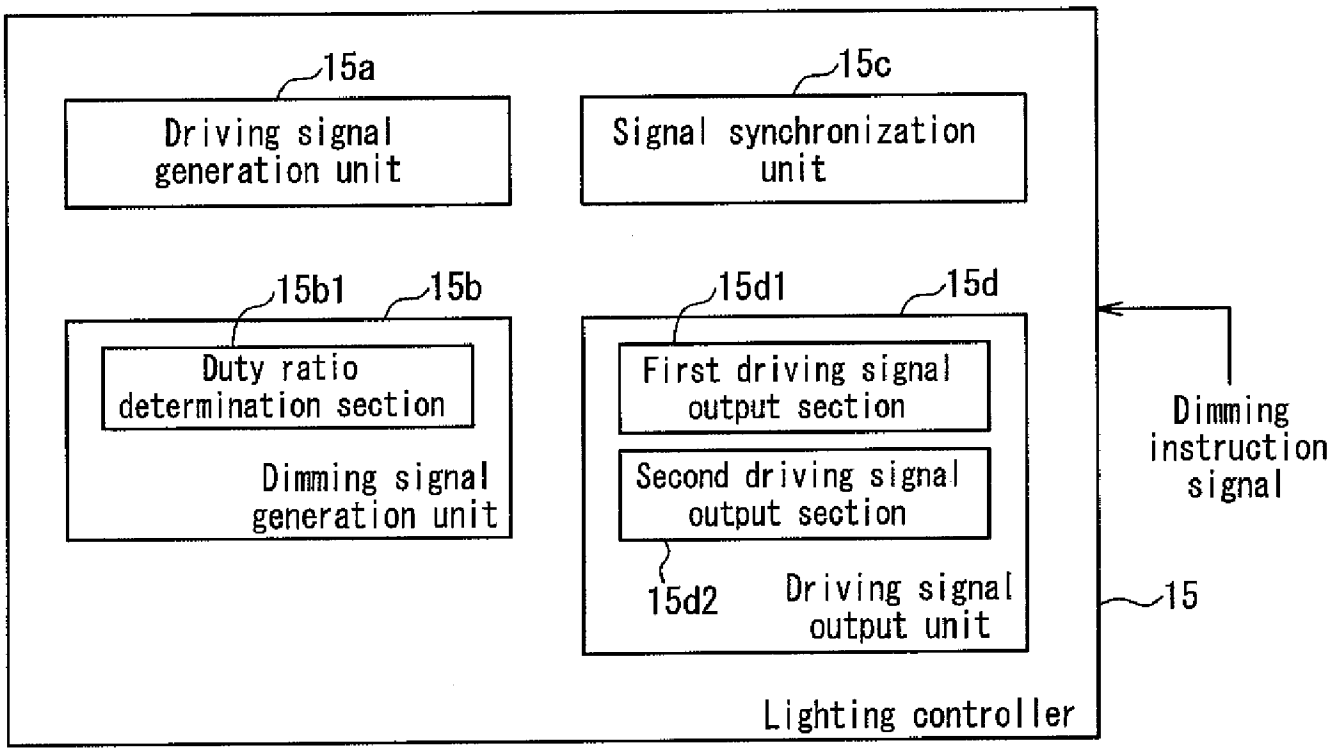
FIG. 5 is a block diagram showing a specific configuration of a lighting controller shown in FIG. 2.

Further, as shown in FIG. 5, the lighting controller 15 includes a driving signal generation unit 15*a*, a dimming signal generation unit 15*b*, a signal synchronization unit 15*c*, and a driving signal output unit 15*d*, and generates outputs first and second driving signals to the inverter circuit 16 connected to each cold-cathode fluorescent tube 9 based on the dimming instruction signal.

In each unit of the lighting controller 15, for example, an IC and an LSI are used, and the lighting controller 15 drives the inverter circuit 16 so that, for example, the first driving signal among the first and second driving signals and the dimming signal generated by the dimming signal generation unit 15*b* are synchronized. That is, the inverter circuit 16 drives the cold-cathode fluorescent tube 9 while the dimming signal in the PWM dimming and the driving signal (first driving signal) for driving the cold-cathode fluorescent tube 9 are synchronized.

Specifically, in the lighting controller 15, the driving signal generation unit 15*a* generates a driving signal for driving the cold-cathode fluorescent tube (light source) 9, and as described above, generates a predetermined driving signal of, for example, 33.9 KHz and outputs the driving signal to the signal synchronization unit 15*c*. As the driving signal generation unit 15*a*, clock signal generation units such as an IC and an LSI included in the lighting control unit 15 can be used.

Further, the dimming signal generation unit 15*b* has a duty ratio determination section 15*b*1, and the duty ratio determination section 15*b*1 determines a duty ratio between a ON-time and an OFF-time during a PWM period in the PWM dimming for each cold-cathode fluorescent tube 9, using a dimming instruction signal (instruction signal) from outside. Then, the dimming signal generation unit 15*b* generates, for example, a dimming signal having a dimming frequency of 140 Hz based on the determined duty ratio, and outputs the dimming signal to the signal synchronization unit 15*c*.

Further, the signal synchronization unit 15*c* synchronizes the driving signal from the driving signal generation unit 15*a* and the dimming signal from the dimming signal generation unit 15*b*, and outputs a synchronization signal (i.e., a dimming signal synchronized with the driving signal) that is the result of the synchronization to the driving signal output unit 15*d*.

Further, in the driving signal output unit 15*d*, first and second driving signal output sections 15*d*1, 15*d*2 that output first and second driving signals respectively to the first and second switching members 16*b* and 16*c* (FIG. 4) of the inverter circuit 16 are provided. The first and second driving signal output sections 15*d*1, 15*d*2 generate the first and second driving signals, using the synchronization signal from the signal synchronization unit 15*c*, so that a driving current in the form of a sine wave is supplied to the cold-cathode fluorescent tube 9.

That is, the first driving signal output section 15*d*1 generates the first driving signal using the synchronization signal from the signal synchronization unit 15*c* and outputs the first driving signal to the first switching member 16*b*. Further, the second driving signal output section 15*d*2 generates the second driving signal by shifting the phase of the first driving signal generated by the first driving signal output section 15*d*1 by 180°, and outputs the second driving signal to the second switching member 16*c*. Thus, the first and second driving signals different in phase by 180° are input to the first and second switching members 16*b*, 16*c*, and thus, a driving current in the form of a sine wave is supplied to the cold-cathode fluorescent tube 9 from the driving power source 16*d* (FIG. 4).

Hereinafter, an operation of the liquid crystal display device 2 of the present embodiment configured as described above will be described specifically with reference to FIG. 6. In the following description, the driving control operation of the inverter circuit 16 in the lighting controller 15 of the lighting device 8 will be described mainly.

Figure 6:
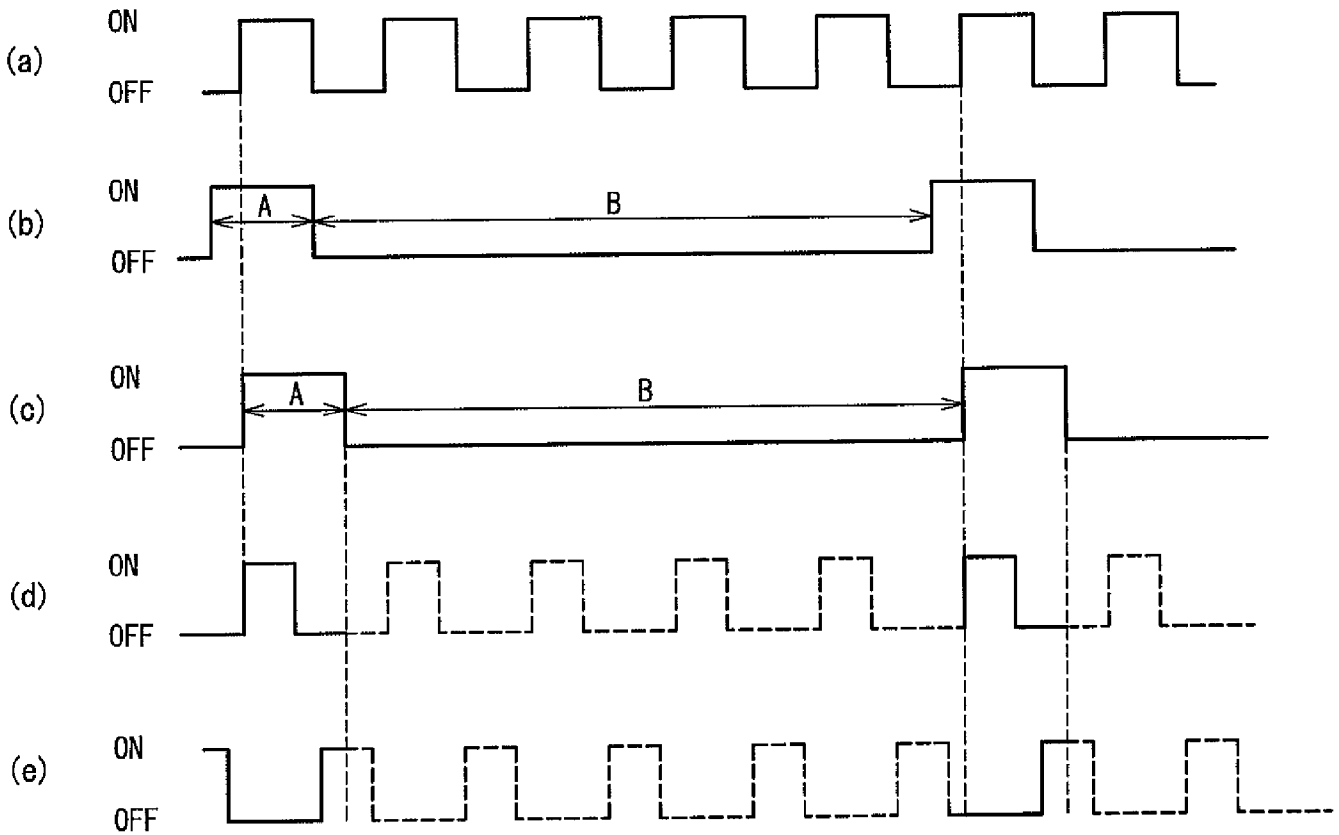
FIG. 6 is a waveform diagram showing a specific signal waveform in each unit of the lighting controller.

FIG. 6 is a waveform diagram showing a specific signal waveform in each unit of the lighting controller. In FIG. 6, for simplicity of the figure, the number of pulses of driving signals shown in FIG. 6(*a*), FIG. 6(*d*), and FIG. 6(*e*) whose frequencies are much larger than those of dimming signals shown in FIG. 6(*b*) and FIG. 6(*c*) is reduced.

In the lighting controller 15 of the present embodiment, as illustrated in FIG. 6(*a*), the driving signal generation unit 15*a* generates, for example, a rectangular driving signal of 33.9 KHz with a duty ratio of 50%. Then, the driving signal generation unit 15*a* outputs the generated driving signal to the signal synchronization unit 15*c*.

Further, in the dimming signal generation unit 15*b*, the duty ratio determination section 15*b*1 determines a duty ratio based on the dimming instruction signal input to the lighting controller 15. Then, as shown in FIG. 6(*b*), the dimming signal generation unit 15*b* generates, for example, a dimming signal of 140 Hz based on the determined duty ratio (ON-time A, OFF-time B) and outputs the dimming signal to the signal synchronization unit 15*c*.

Further, the signal synchronization unit 15*c* synchronizes the driving signal from the driving signal generation unit 15*a* and the dimming signal from the dimming signal generation unit 15*b* to generate a synchronization signal shown in FIG. 6(*c*), and outputs the synchronization signal to the first driving signal output section 15*d*1. Specifically, the signal synchronization unit 15*c* generates the synchronization signal based on the driving signal and the dimming signal so that the rising phase of the driving signal is matched with the rising phase of the dimming signal. Further, the synchronization signal rises at alternate periods: a period corresponding to 242 pulses of the driving signal and a period corresponding to 243 pulses of the driving signal.

More specifically, the frequency of the driving signal and the frequency of the dimming signal are 33900 Hz and 140 Hz, respectively, and hence, in order to synchronize the driving signal and the dimming signal, the period of one pulse of the dimming signal should include about 242.143 (=33900/140) pulses of the driving signal. Thus, the signal synchronization unit 15*c* generates the synchronization signal while varying the period of the synchronization signal slightly as described above.

The period of the synchronization signal is varied slightly, and hence, in the lighting device 8 of the present embodiment, for example, an ON-time is shifted alternately by a very minute time (1/33900 (sec.)) so that the frequency (140 Hz) of the dimming signal is kept in the PWM dimming. As described above, the ON-time is shifted by a very minute time, and hence, the lighting operation of the cold-cathode fluorescent tube 9 is not recognized visually as flickering.

Furthermore, in the driving signal output unit 15*d*, the first driving signal output section 15*d*1 generates the first driving signal shown in FIG. 6(*d*), using the synchronization signal from the signal synchronization unit 15*c*. Specifically, the first driving signal output section 15*d*1 generates the first driving signal so that the rising phase of the synchronization signal is matched with the rising phase of the first driving signal. Further, the first driving signal output section 15*d*1 changes a duty ratio appropriately so that a driving current supplied from the secondary winding side of the transformer 16*a* to the cold-cathode fluorescent tube 9 creates a sine wave, and generates the first driving signal.

Further, the second driving signal output section 15*d*2 generates the second driving signal shown in FIG. 6(*e*), using the first driving signal generated by the first driving signal output section 15*d*1. More specifically, the second driving signal output section 15*d*2 generates the second driving signal by shifting the phase of the first driving signal from the first driving signal output section 15*d*1 by 180°. Then, the first and second driving signal output sections 15*d*1, 15*d*2 output the first and second driving signals different in phase by 180° to the first and second switching members 16*b*, 16*c* simultaneously. Thus, the driving current in the form of a sine wave is supplied to the cold-cathode fluorescent tube 9 (not shown).

As indicated by a solid line and a dotted line in FIG. 6(*d*) and FIG. 6(*e*), the first and second driving signals are respectively output to the first and second switching members 16*b*, 16*c* only during the ON-time of the synchronization signal (dimming signal) shown in FIG. 6(*c*), and are not output during the OFF-time. Further, the driving current starts rising at a time of rising of the first driving signal, and the driving current starts falling at a time of rising of the second driving signal.

In the lighting device 8 of the present embodiment configured as descried above, the inverter circuit 16 drives the cold-cathode fluorescent tube 9 while the dimming signal in the PWM dimming and the driving signal for driving the cold-cathode fluorescent tube (light source) 9 are synchronized. Thus, in the lighting device 8 of the present embodiment, unlike the conventional example, the lighting operation of the cold-cathode fluorescent tube (light source) 9 can be prevented from being recognized visually as flickering. Consequently, in the present embodiment, a lighting device excellent in light-emission quality capable of preventing the occurrence of flickering can be configured.

Further, in the lighting device 8 of the present embodiment, as shown in FIG. 6(*c*) to FIG. 6(*e*), the lighting controller 15 outputs the first and second driving signals respectively to the first and second switching members 16*b*, 16*c* while the first driving signal among the first and second driving signals is synchronized with the dimming signal. This can prevent the occurrence of flickering in the cold-cathode fluorescent tube 9 exactly.

Further, in the liquid crystal display device 2 of the present embodiment, the lighting device 8 excellent in light-emission quality capable of preventing the occurrence of flickering is used, and hence, the liquid crystal display device 2 having excellent display quality can be configured easily.

In the above-mentioned description, the configuration in which the driving signal generation unit 15*a* is provided in the lighting controller 15 to generate a driving signal has been described. However, the present embodiment is not limited thereto, and for example, the driving signal also can be generated using a horizontal synchronization signal or a vertical synchronization signal contained in a video signal input from outside to the liquid crystal driving unit 14.

[Embodiment 2]

Figure 7:
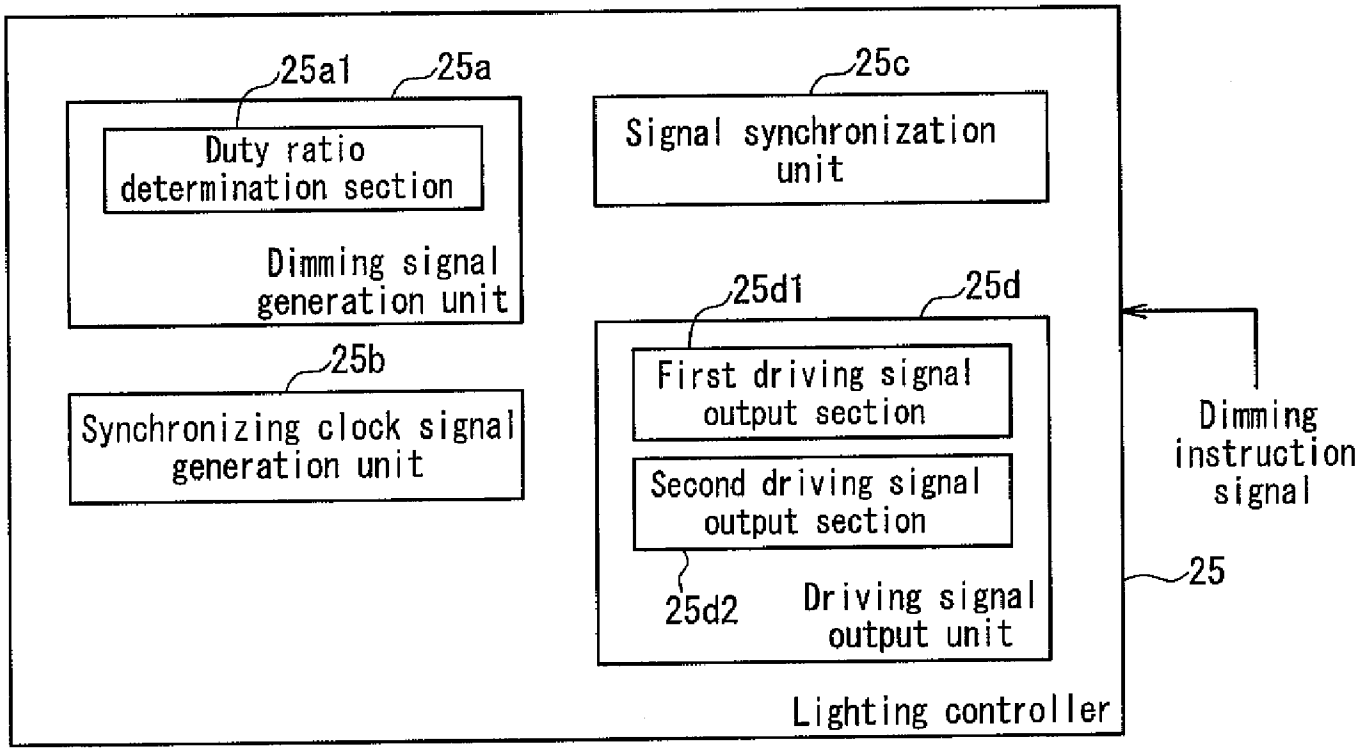
FIG. 7 is a block diagram showing a specific configuration of a lighting controller of a lighting device according to Embodiment 2 of the present invention.

FIG. 7 is a block diagram showing a specific configuration of a lighting controller of a lighting device according to Embodiment 2 of the present invention. In FIG. 7, the main differences between the present embodiment and Embodiment 1 lie in that a synchronizing clock signal generation unit that generates a synchronizing clock signal is provided in a controller, and the controller synchronizes a dimming signal with the synchronizing clock signal and generates a driving signal, using the synchronized dimming signal. The same elements as those in Embodiment 1 are denoted with the same reference numerals as those therein, and the repeated descriptions thereof are omitted.

More specifically, as illustrated in FIG. 7, the lighting controller 25 of the lighting device 8 of the present embodiment includes a dimming signal generation unit 25*a*, a synchronizing clock signal generation unit 25*b*, a signal synchronization unit 25*c*, and a driving signal output unit 25*d*, and in the same way as in Embodiment 1, the lighting controller 25 generates and outputs first and second driving signals to the inverter circuits 16 connected to the respective cold-cathode fluorescent tubes 9.

Further, in each unit of the lighting controller 25, for example, an IC or an LSI is used, and the lighting controller 25 drives the inverter circuit 16 so that, for example, the first driving signal among the first and second driving signals and the dimming signal generated by the dimming signal generation unit 25*a* are synchronized. Then, the inverter circuit 16 drives the cold-cathode fluorescent tube 9 while the dimming signal in the PWM dimming and the driving signal (first driving signal) for driving the cold-cathode fluorescent tube 9 are synchronized.

Specifically, in the lighting controller 25, the dimming signal generation unit 25*a* has a duty ratio determination section 25*a*1, and the duty ratio determination section 25*a*1 determines a duty ratio between the ON-time and the OFF-time during a PWM period in the PWM dimming for each cold-cathode fluorescent tube 9, using a dimming instruction signal (instruction signal) from outside. Then, the dimming signal generation unit 25*a* generates, for example, a dimming signal having a dimming frequency of 140 Hz based on the determined duty ratio, and outputs the dimming signal to the signal synchronization unit 25*c*.

Further, the synchronizing clock signal generation unit 25*b* generates a synchronizing clock signal to be synchronized with the dimming signal generated by the dimming signal generation unit 25*a*. Further, the synchronizing clock signal generation unit 25*b* outputs the generated synchronizing clock signal to the signal synchronization unit 25*c* and the driving signal output unit 25*d*. The synchronizing clock signal is a rectangular signal having a frequency larger than that of the driving signal of the cold-cathode fluorescent tube 9, for example, a frequency of 1 MHz, and is converted into the above-mentioned driving signal as described later.

Further, the signal synchronization unit 25*c* synchronizes the dimming signal from the dimming signal generation unit 25*a* with the synchronizing clock signal from the synchronizing clock signal generation unit 25*b*, thereby outputting the synchronization signal (i.e., the dimming signal synchronized with the synchronizing clock signal) that is the result of the synchronization to the driving signal output unit 25*d*.

Further, in the same way as in Embodiment 1, the driving signal output unit 25*d* includes first and second driving signal output sections 25*d*1, 25*d*2 that output first and second driving signals respectively to the first and second switching members 16*b* and 16*c* (FIG. 4) of the inverter circuit 16. The first and second driving signal output sections 25*d*1, 25*d*2 generate the first and second driving signals, using the synchronizing clock signal from the synchronizing clock signal generation unit 25*b* and the synchronization signal from the signal synchronization unit 25*c*, so that a driving current in the form of a sine wave is supplied to the cold-cathode fluorescent tube 9.

That is, the first driving signal output section 25*d*1 uses the synchronizing clock signal from the synchronizing clock signal generation unit 25*b* and the synchronization signal from the signal synchronization unit 25*c* to generate a first driving signal, and outputs the first driving signal to the first switching member 16*b*. Further, the second driving signal output section 25*d*2 shifts the phase of the first driving signal generated by the first driving signal output section 25*d*1 by 180° to generate a second driving signal, and outputs the second driving signal to the second switching member 16*c*. As a result, in the same way as in Embodiment 1, a driving current in the form of a sine wave is supplied from the driving power source 16*d* (FIG. 4) to the cold-cathode fluorescence tube 9.

Hereinafter, an operation of the liquid crystal display device 2 of the present embodiment configured as described above will be described specifically also with reference to FIG. 8. In the following description, an operation of driving the inverter circuit 16 in the lighting controller 25 of the lighting device 8 will be described mainly.

Figure 8:
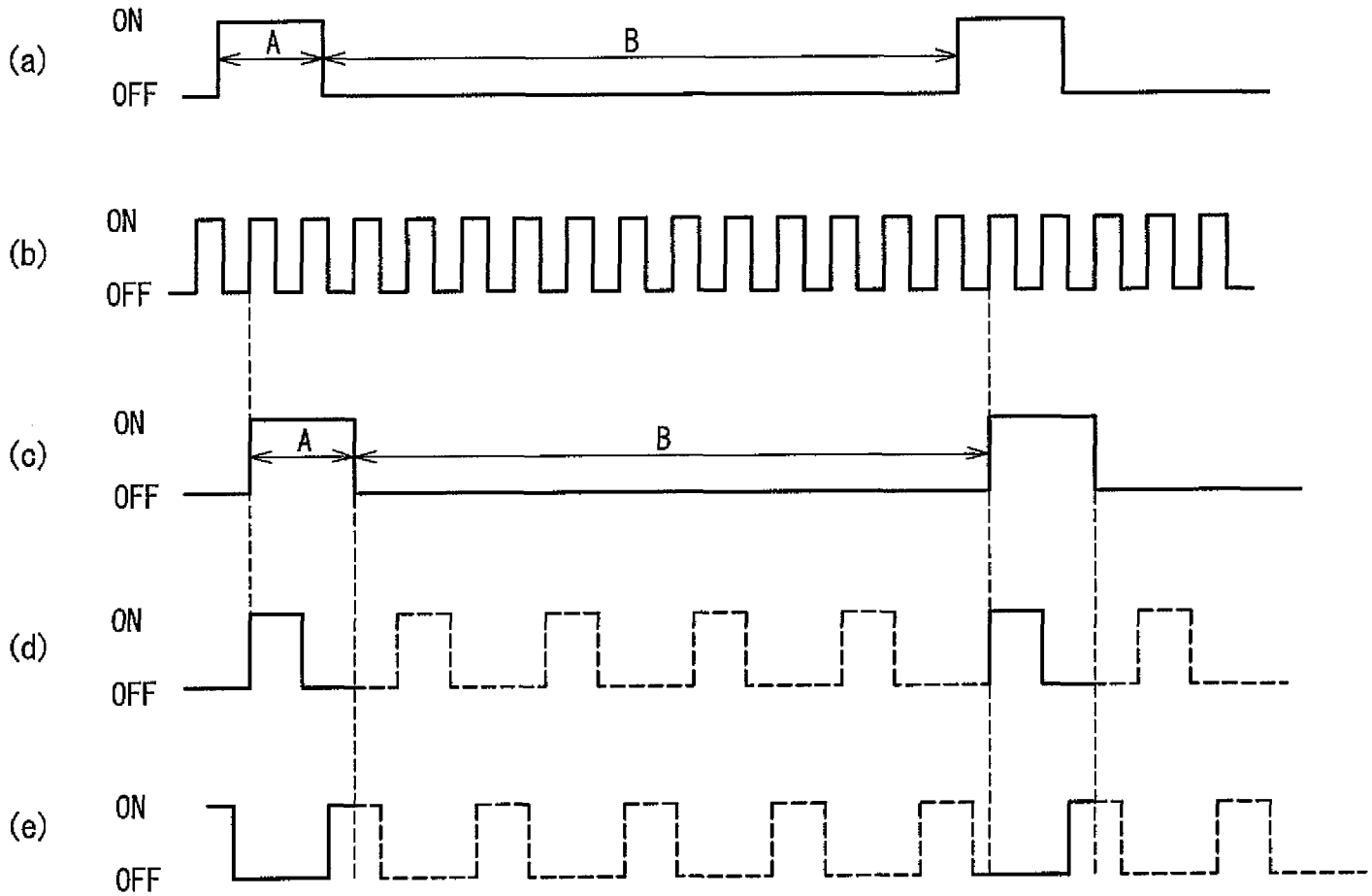
FIG. 8 is a waveform diagram showing a specific signal waveform in each unit of the lighting controller shown in FIG. 7.

FIG. 8 is a waveform diagram showing a specific signal waveform in each unit of the lighting controller shown in FIG. 7. In FIG. 8, for simplicity of the figure, the number of pulses of the synchronizing clock signal shown in FIG. 8(*b*) and the number of pulses of the driving signals shown in FIG. 8(*d*) and FIG. 8(*e*) whose frequencies are much larger than those of the dimming signals shown in FIG. 8(*a*) and FIG. 8(*c*) are reduced.

In the lighting controller 25 of the present embodiment, the duty ratio determination section 25*a*1 of the dimming signal generation unit 25*a* determines a duty ratio based on the dimming instruction signal input to the lighting controller 25. Then, as shown in FIG. 8(*a*), the dimming signal generation unit 25*a* generates, for example, a dimming signal of 140 Hz based on the determined duty ratio (ON-time A, OFF-time B) and outputs the dimming signal to the signal synchronization unit 25*c*.

Further, as shown in FIG. 8(*b*), the synchronizing clock signal generation unit 25*b* generates, for example, a rectangular synchronizing clock signal of 1 MHz, having a duty ratio of 50%. Then, the synchronizing clock signal generation unit 25*b* outputs the generated synchronizing clock signal to the signal synchronization unit 25*c* and the driving signal output unit 25*d*.

Further, the signal synchronization unit 25*c* synchronizes the dimming signal from the dimming signal generation unit 25*a* with the synchronizing clock signal from the synchronizing clock signal generation unit 25*b* to generate a synchronization signal (dimming signal) shown in FIG. 8(*c*), and outputs the synchronization signal to the first driving signal output section 25*d*1. Specifically, the signal synchronization unit 15*c* generates the synchronization signal based on the dimming signal and the synchronizing clock signal so that the rising phase of the dimming signal is matched with the rising phase of the synchronizing clock signal.

Further, the driving signal output unit 25*d* generates the first driving signal shown in FIG. 8(*d*) using the synchronizing clock signal from the synchronizing clock signal generation unit 25*b* and the synchronization signal from the signal synchronization unit 25*c*. Specifically, the first driving signal output section 25*d*1 counts the synchronizing clock signal based on the rising of the synchronization signal so that the rising phase of the synchronization signal is matched with the rising phase of the first driving signal, thereby generating the first driving signal of 33.9 KHz.

The first driving signal output section 25*d*1 sets the frequency of one pulse at a frequency slightly larger than 33.9 KHz in a period of the synchronization signal in the first driving signal, thereby matching the rising phase of the first driving signal with the rising phase of the synchronization signal at all times.

That is, as described above, it is necessary to allow a period of one pulse of the dimming signal to include about 242.143 (=33900/140) pulses of the driving signal. Therefore, the rising phase of the first driving signal is matched with the rising phase of the synchronization signal at all times with the frequency being 33.9 KHz+4.85 KHz (≈33900×0.143) only in one pulse of the first driving signal in a period of the synchronization signal. Thus, in the lighting controller 25 of the present embodiment, unlike Embodiment 1, the ON-time in the PWM dimming can be prevented from being shifted alternately by a very minute time.

Further, in the same way as in Embodiment 1, the first driving signal output section 25*d*1 changes a duty ratio appropriately so that a driving current supplied from the secondary winding side of the transformer 16*a* to the cold-cathode fluorescent tubes 9 has a sine wave.

Further, the second driving signal output section 25*d*2 generates the second driving signal shown in FIG. 8(*e*), using the first driving signal generated by the first driving signal output section 25*d*1. More specifically, the second driving signal output section 25*d*2 generates the second driving signal by shifting the phase of the first driving signal from the first driving signal output section 25*d*1 by 180°. Then, the first and second driving signal output sections 25*d*1, 25*d*2 output the first and second driving signals different in phase by 180° to the first and second switching members 16*b*, 16*c*. Thus, a driving current in the form of a sine wave is supplied to the cold-cathode fluorescent tubes 9 (not shown).

As indicated by a solid line and a dotted line in FIG. 8(*d*) and (*e*), in the same way as in Embodiment 1, the first and second driving signals are output respectively to the first and second switching members 16*b*, 16*c* only during the ON-time of the synchronization signal (dimming signal) shown in FIG. 8(*c*), and are not output during the OFF-time. Further, the driving signal starts rising at a time of rising of the first driving signal, and the driving current starts falling at a time of rising of the second driving signal.

Due to the above-mentioned configuration, the present embodiment can exhibit functions and effects similar to those of Embodiment 1. Further, in the lighting device 8 of the present embodiment, the lighting controller 25 synchronizes the dimming signal with the synchronizing clock signal, and generates the first and second driving signals (driving signals), using the synchronized synchronization signal (dimming signal). Thus, the driving signal and the dimming signal can be synchronized with a high precision without decreasing the dimming precision in the PWM dimming, and the lighting device 8 excellent in light-emission quality can be configured more exactly.

The above-mentioned embodiments are all shown as an illustration and not limiting. The technical range of the present invention is defined by the scope of the claims, and all the alterations within the range equivalent to the configuration recited in the claims also are included in the technical range of the present invention.

For example, in the above-mentioned description, the case where the present invention is applied to a transmission-type liquid crystal display device has been described. However, the lighting device of the present invention is not limited thereto, and the present invention can be applied to various display devices having a non-light-emitting display portion that displays information such as images and characters, using light from a light source. Specifically, the lighting device of the present invention can be used preferably in a semi-transmission type liquid crystal display device or a projection-type display device using a liquid crystal panel for a light valve.

Further, besides the above description, the present invention can be used preferably as a lighting device for a film viewer that irradiates an X-ray photograph with light, a light box that irradiates a negative or the like with light to make it easy to recognize the negative visually, or a light-emitting device for lighting up a signboard or advertisement set on a wall surface in a station premise.

Further, in the above description, although the case using a cold-cathode fluorescent tube has been described, the light source of the present invention is not limited thereto, and other discharge fluorescent tubes such as a hot cathode fluorescent tube and a xenon fluorescent tube, or non-straight discharge fluorescent tubes such as a U-tube and a pseudo-U-tube also can be used. Further, other light-emitting devices such as a plurality of light-emitting diodes (LEDs) arranged linearly also can be used.

More specifically, the present invention includes an inverter circuit connected to a light source and configured so as to drive the light source, using PWM dimming. The inverter circuit may be the one that drives the light source while the dimming signal in the PWM dimming and the driving signal for driving the light source are synchronized, and the kind, setting number, and driving system of the light source, the configuration of the inverter circuit, or the like is not limited to those described above.

Specifically, in the above-mentioned description, the case of using a half-bridge type inverter circuit has been described. However, a full-bridge type inverter circuit having, for example, four switching members can be applied to the inverter circuit. In the case where such the full-bridge type inverter circuit is applied to the inverter circuit, a driving signal output to any of the four switching members may be synchronized with the dimming signal.

Further, in the case of using a discharge fluorescent tube containing no mercury such as the above-mentioned xenon fluorescent tube, a lighting device with an increased longevity having discharge tubes arranged in parallel to a gravity acting direction can be configured.

Further, in the above-mentioned description, as shown in FIG. 6 or 8, the configuration has been descried in which the dimming signal and the driving signal are synchronized while the rising phases thereof are matched. However, the present invention is not limited thereto, and at least one of each rising phase and each falling phase the dimming signal and the driving signal may be matched.

Figure 9:
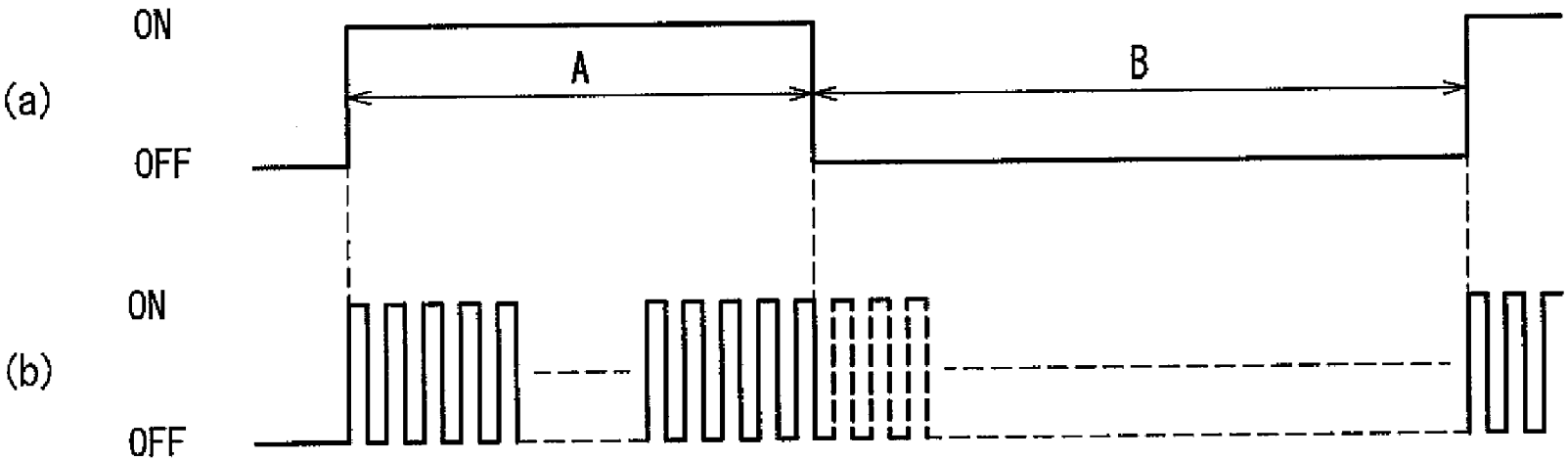
FIG. 9 is a waveform diagram showing a specific signal waveform in a modified example of the lighting controller of the present invention.

Specifically, for example, in the dimming signal shown in FIG. 9(*a*) and the (first) driving signal shown in FIG. 9(*b*), both the rising phase and the falling phase may be matched as shown in FIG. 9.

Further, in the above-mentioned description, a configuration has been described in which an inverter circuit is set at one end in a longitudinal direction of the cold-cathode fluorescent tube, and a current is supplied to the cold-cathode fluorescent tube from one end. However, the present invention is not limited thereto, and an inverter circuit may be set at one end and the other end, respectively, in the longitudinal direction of the cold-cathode fluorescent tube, and a current may be supplied to the cold-cathode fluorescent tube from one side and the other side.

Industrial Applicability

The present invention is useful for a lighting device excellent in light-emission quality capable of preventing the occurrence of flickering and a display device using the lighting device.

The invention claimed is:

1. A lighting device having a light source, comprising:

an inverter circuit connected to the light source and configured so as to drive the light source, using PWM dimming, and a controller that generates a driving signal, and determines a duty ratio in the PWM dimming, using an instruction signal input from outside and that generates a dimming signal based on the determined duty ratio, thereby controlling the inverter circuit; wherein the inverter circuit drives the light source while the dimming signal in the PWM dimming and the driving signal for driving the light source are synchronized;

the controller includes a synchronizing clock signal generation unit that generates a synchronizing clock signal; and the controller synchronizes the dimming signal with the synchronizing clock signal from the synchronizing clock signal generation unit, and generates the driving signal, using the synchronized dimming signal.

2. The lighting device according to claim 1, wherein the inverter circuit includes first and second switching members that receive first and second driving signals different in phase by 180° as the driving signal from the controller, and performs ON/OFF control of supply of power to the light source, and the controller outputs the first and second driving signals respectively to the first and second switching members while one driving signal of the first and second driving signals and the dimming signal are synchronized.

3. The lighting device according to claim 1, wherein the dimming signal and the driving signal are set so that rising phases are matched.

4. The lighting device according to claim 1, wherein the dimming signal and the driving signal are set so that falling phases are matched.

5. The lighting device according to claim 1, wherein a cold-cathode fluorescent tube is used as the light source.

6. A display device using the lighting device according to claim 1.

* * * * *